US005942973A

United States Patent [19]

Lee

[11] Patent Number: 5,942,973

[45] Date of Patent: Aug. 24, 1999

[54] LOCKING SYSTEM FOR A SECURITY CONTAINER

[75] Inventor: Kyeong Ryong Lee, Kyungki-do, Rep. of Korea

[73] Assignee: LG Electronics Inc., Seoul, Rep. of Korea

[21] Appl. No.: 09/050,012

[22] Filed: Mar. 30, 1998

[30] Foreign Application Priority Data

Mar. 31, 1997 [KR] Rep. of Korea ..... 97-11545

[51] Int. Cl.[6] ..... E05B 45/06

[52] U.S. Cl. ..... 340/542; 340/543; 70/1.5; 70/279; 70/283; 70/333 R; 109/40; 109/43; 109/63.5

[58] Field of Search ..... 340/542, 543; 70/77, 78, 115, 222, 184, 1.5, 416, 422, 279, 283, 333 R; 109/59 R, 40, 41, 43, 63.5

[56] References Cited

U.S. PATENT DOCUMENTS

| | | | |
|---|---|---|---|
| 3,829,834 | 8/1974 | Frankland et al. | 340/543 |
| 4,266,488 | 5/1981 | Markham | 109/59 R |
| 4,455,552 | 6/1984 | Greiner et al. | 340/543 |
| 4,493,199 | 1/1985 | Uyeda | 70/333 R |
| 4,562,706 | 1/1986 | Pickett et al. | 70/1.5 |
| 4,754,629 | 7/1988 | Allen | 70/333 R |
| 4,772,877 | 9/1988 | Rice, Jr. et al. | 340/543 |
| 4,901,057 | 2/1990 | Suneborn | 340/542 |
| 4,904,984 | 2/1990 | Gartner et al. | 340/543 |
| 5,196,841 | 3/1993 | Harder et al. | 340/825.31 |
| 5,231,935 | 8/1993 | Oder et al. | 109/59 R |
| 5,503,441 | 4/1996 | Schwaiger | 292/336.3 |
| 5,632,170 | 5/1997 | Evans | 70/303 A |
| 5,684,457 | 11/1997 | Miller et al. | 340/543 |

*Primary Examiner*—Daniel J. Wu
*Assistant Examiner*—Toan Pham
*Attorney, Agent, or Firm*—Finnegan, Henderson, Farabow, Garrett & Dunner, L.L.P.

[57] ABSTRACT

A locking system for a security container includes a frame in cabinet form, a jamb formed on the frame, a movable locker plate which determines opening and closing of a door by overlapping with the jamb and which is formed on the door, a combination lock determining the movement of the locker plate, and a double relocking system including a first relocking system operated when a dial portion of the combination lock is attacked, and a second relocking system operated when a cam bolt portion of said combination lock is attacked.

10 Claims, 12 Drawing Sheets

LOCKING SYSTEM FOR A SECURITY CONTAINER

BACKGROUND OF THE INVENTION

The present invention relates to a locking system for a security container in an automated teller machine or a cash dispenser, and particularly to a locking system for a security container having an improved relocking system.

A conventional locking system for a security container as shown in FIG. 1*a* and FIG. 1*b,* comprises a frame 20 in cabinet form, a jamb 21 formed on the frame 20, a locker 25 which is formed to be movable on a door 10 hinged to the frame 20 and which determines opening and closing of the door 10 according to overlapping with the jamb 21, a handle 11 which is formed on the outer surface of the door 10 to move the locker 25 right and left, a combination lock 30 which determines the movement of the locker 25 according to insertion of a cam bolt 31 into a hole of the locker 25, a dial 32 which is disposed on the outer surface of the door 10 and is connected to the combination lock 30, and a relocking system 40 automatically preventing the movement of the locker 25 when the combination lock 30 is attacked.

The relocking system 40 comprises a relocker bolt 41 which is inserted into a spring 43 fixed to a bracket 14 of the door 10 and which is forced up by the spring 43 to be combined with a relocker supporting flange of the locker, thereby preventing the opening of the door 10, a relocker holding bracket 42 to block the movement of the relocker bolt 41 until the relocker holding bracket 42 is deformed. The locker 25 comprises a locker plate 25*a* disposed at the combination lock 30, and a main locker 25*b* which is formed in a single body with the locker plate 25*a* and is supported by a locker bracket 12 formed on the door 10.

In the conventional locking system, the relocking system 40 operates to prevent opening of the door 10 when the combination lock 30 is attacked by an invader.

FIG. 2 shows the conventional locking system when the door 10 is normally opened. After the cam bolt 31 retracts into the combination lock 30 by turning the dial 32, the locker 25 is moved left to be free from the jamb 21 by rotating the handle 11, and thereby the door 10 is opened.

When an invader attacks the combination lock 30 in order to open the door 10 by force, the relocking system 40 automatically operates to prevent opening of the door 10.

FIG. 3 shows the conventional locking system when the relocking system 40 is operated. When an invader attacks or penetrates the cam bolt portion of the combination lock 30 or the cam bolt supporting flange portion of the locker 25, the relocker holding bracket 42 disposed thereon is deformed to release the relocker bolt 41. Consequently, the relocker bolt 41 is forced up by the spring 43 so as to fix the locker 25. Therefore, in order to open the door 10 by force, the invader should break the relocking system 40 in addition to the cam bolt 31 of the combination lock 30.

Because the invader may require a long time to destroy both the combination lock 30 and the relocking system 40, a security man or a policeman may have enough time to arrest the invader.

However, in the conventional locking system, the relocking system 40 is set solely at the cam bolt portion of the combination lock 30. Therefore, if the invader attacks the dial portion of the combination lock 30, the relocker system 40 can not be operated. In this case, the invader can open the door by putting the cam bolt 31 into the combination lock 30 manually without the relocker system 40 being operated.

That is, if the combination lock 30 is precisely attacked so that the cam bolt bracket 42 is not deformed, the door 10 can be opened by an invader.

SUMMARY OF THE INVENTION

The objects of the present invention are to overcome problems and disadvantages of the conventional device.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

An object of the present invention is to provide a locking system for a security container having a relocking system which operates so that police or security men have sufficient time to arrest an invader.

According to one embodiment of the invention, the locking system includes a container, a door hinged to the container, a combination lock controlling opening of the door, and a plurality of relocking systems. Each relocking system prevents opening of the door whenever a corresponding portion of the combination lock is deformed. In this locking system, no matter what portion of the combination lock is attacked, a relocking system operates. Accordingly, the invader cannot open the door or requires too long a time to forcefully open the door.

According to another embodiment of the invention, the locking system includes a relocking system which prevents opening of the door whenever the combination lock is deformed and a switch which transmits an alarm signal whenever the relocking system is activated.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

BRIEF DESCRIPTION OF THE DRAWINGS

FIG. 10 is a view showing the locking system of the present invention when the micro switches are turned on.

DETAILED DESCRIPTION OF THE INVENTION

Reference will now be made in detail to the present preferred embodiments of the invention, examples of which are illustrated in the accompanying drawings. Wherever possible, the same reference numbers will be used throughout the drawings to refer to the same or like parts.

Figure 1A:
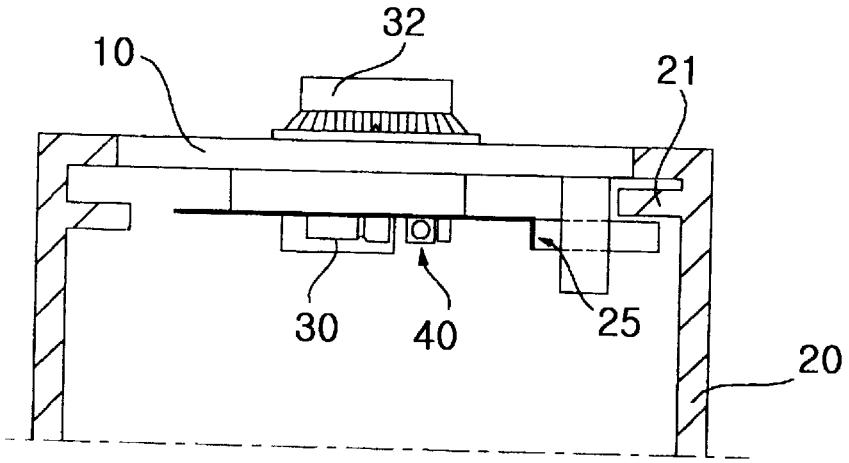
FIG.1a PRIOR ART
FIG. 1*a* and FIG. 1*b* are top and side views showing the conventional locking system for a security container.
Figure 1B:
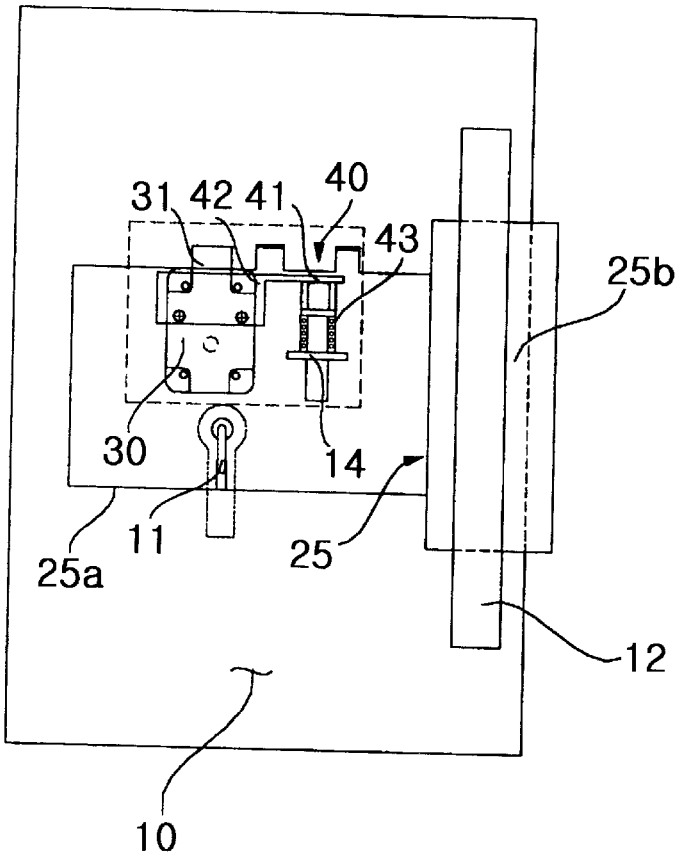
FIG.1b PRIOR ART
Figure 2:
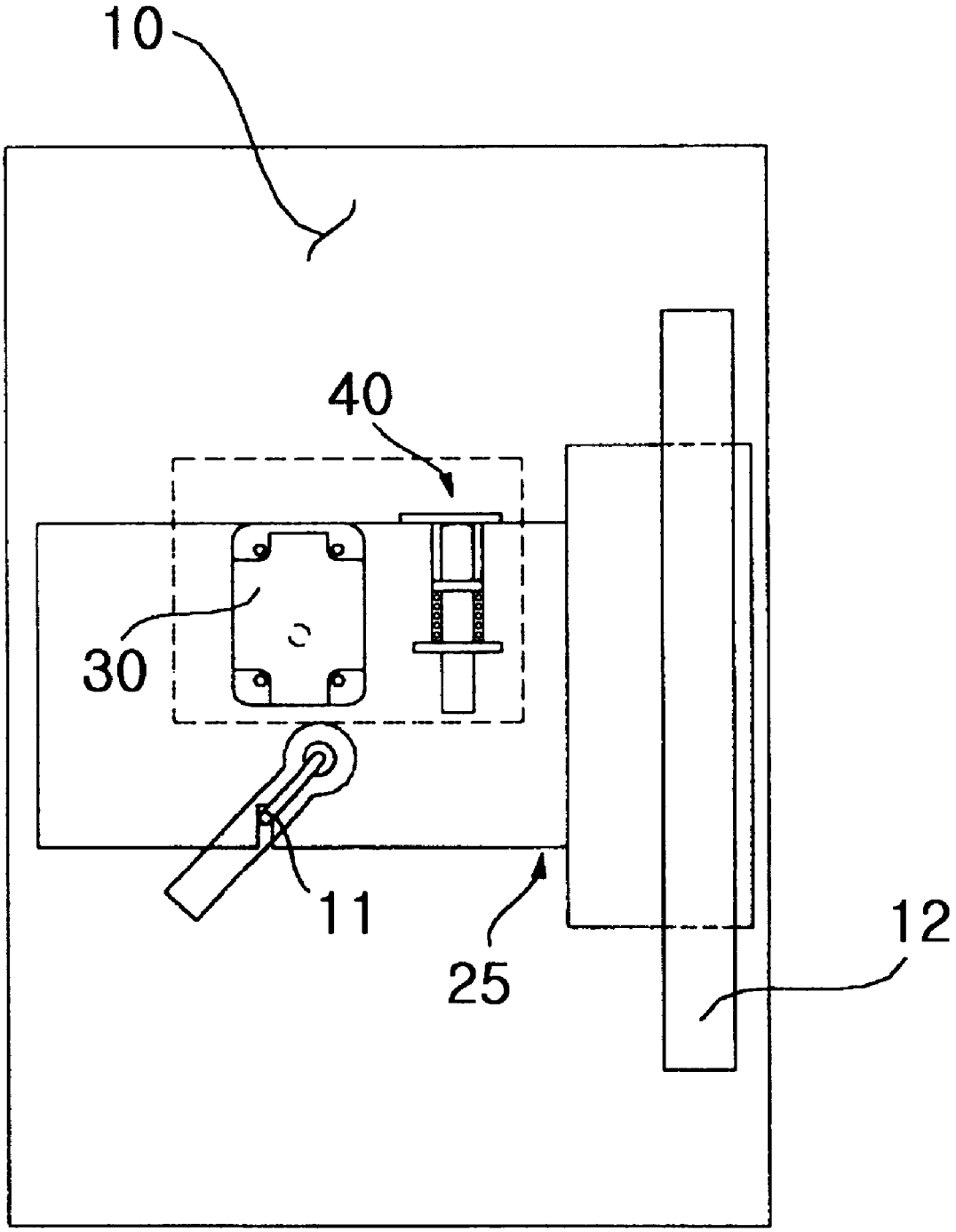
FIG.2 PRIOR ART
FIG. 2 is a side view showing the conventional locking system when the door is normally opened.
Figure 3:
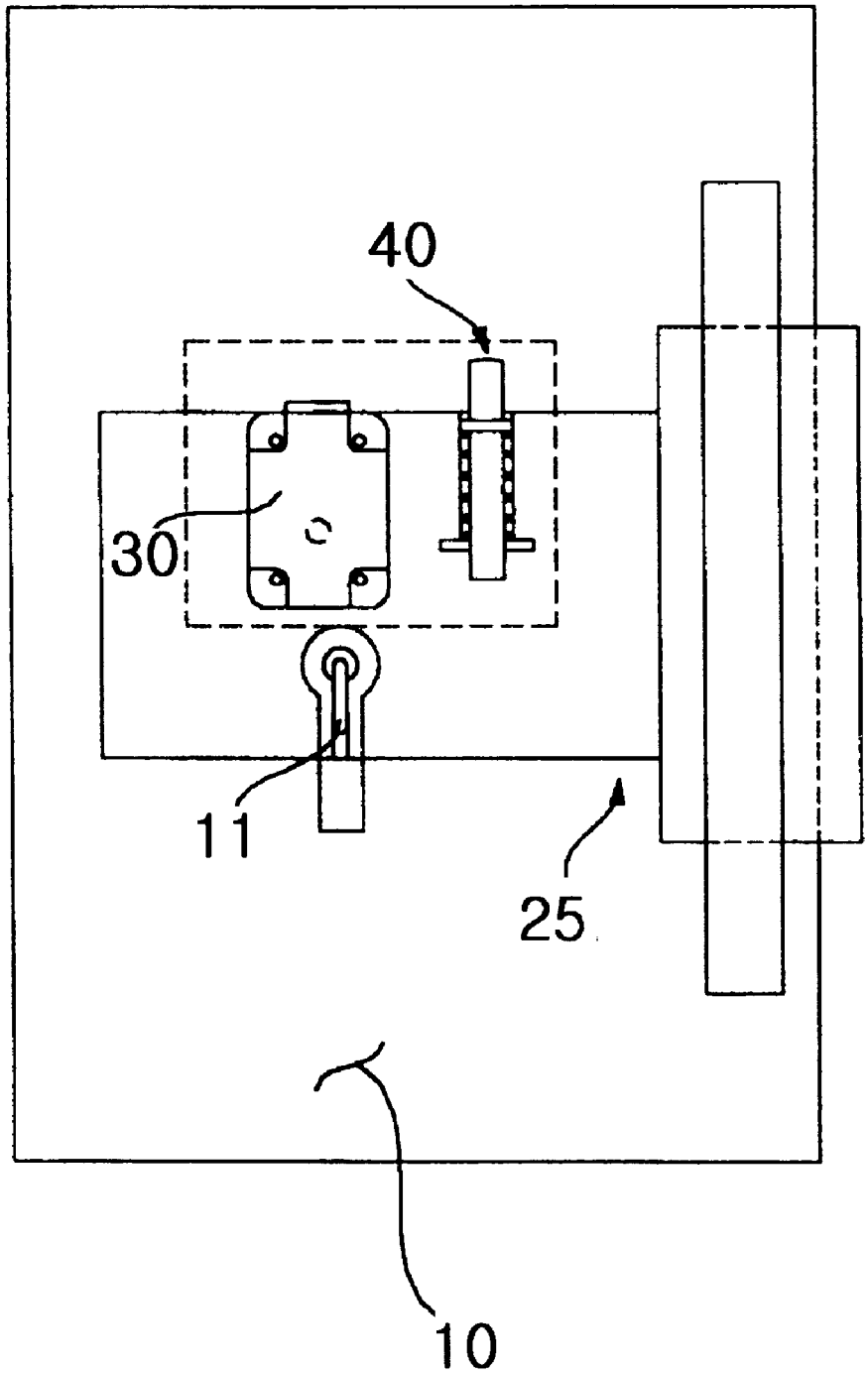
FIG.3 PRIOR ART
FIG. 3 is a side view showing the conventional locking system when the relocking system is operated.
Figure 4:
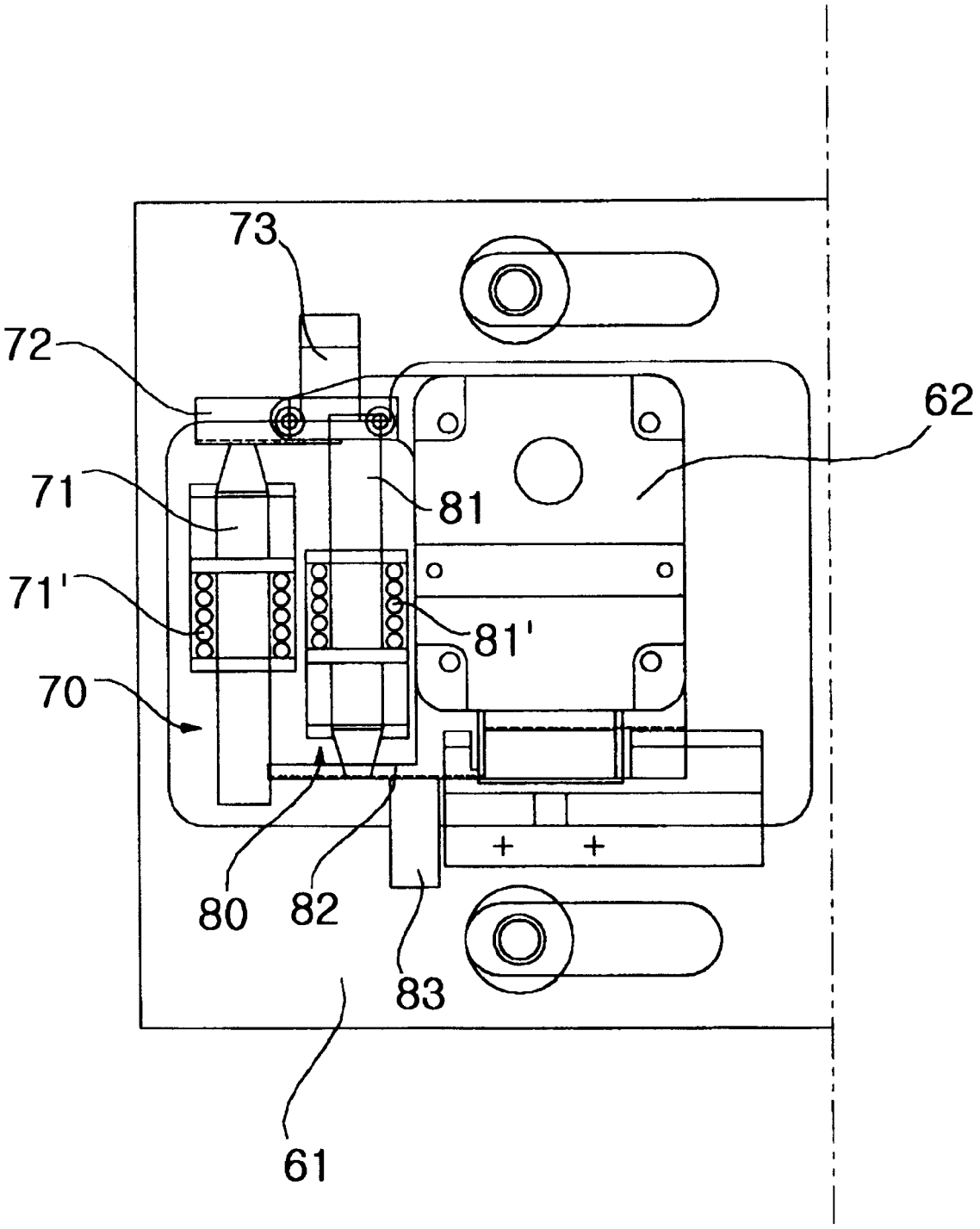
FIG. 4 is a side view showing the locking system according to the present invention.

As shown in FIG. 4, the locking system to the present invention comprises a frame in cabinet form (not illustrated), a jamb (not illustrated) formed on the frame, a locker plate 61 which is formed to be movable on a door (not illustrated) hinged to the frame and which determines opening and closing of the door by overlapping with the jamb. In addition, it comprises a combination lock 62, a relocker top system 70 to prevent the movement of the locker plate 61 when a dial portion of the combination lock 62 is attacked, and a relocker cam bolt system 80 to prevent the movement of the locker plate 61 when a cam bolt portion of the combination lock 62 is attacked.

Figure 5:
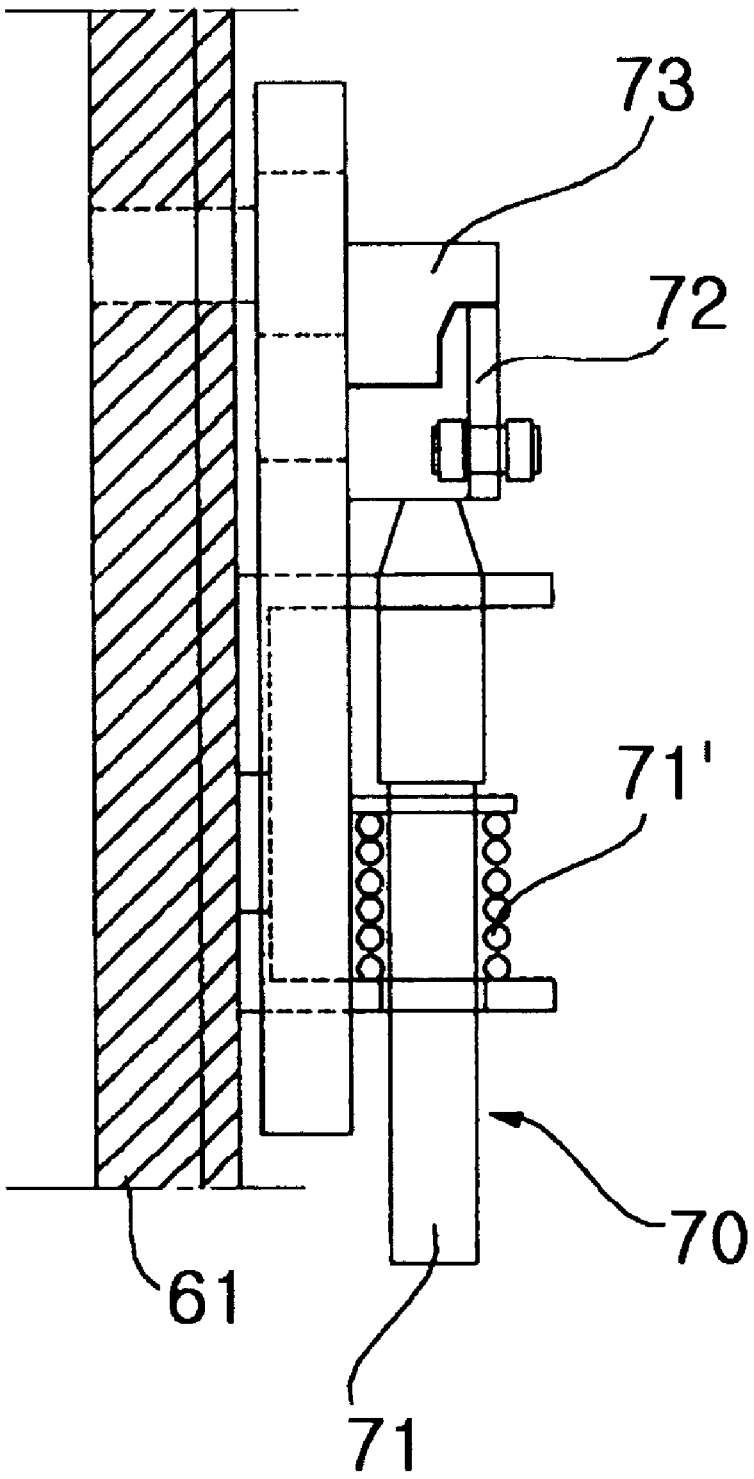
FIG. 5 is a sectional view showing the relocker top system of the present invention.

As shown in FIG. 5, the relocker top system 70 comprises a relocker top 71 which is inserted into a first spring 71' fixed to a bracket of the door and which is moved up by the first spring 71', a lock cover 72 formed to block the movement of the relocker top 71 until the lock cover 72 is damaged or deformed, and a first stop block 73 which is formed on the locker plate 61 and prevents the movement of the locker plate 61 when the relocker top 71 is moved up to be in contact with the first stop block 73.

Figure 6:
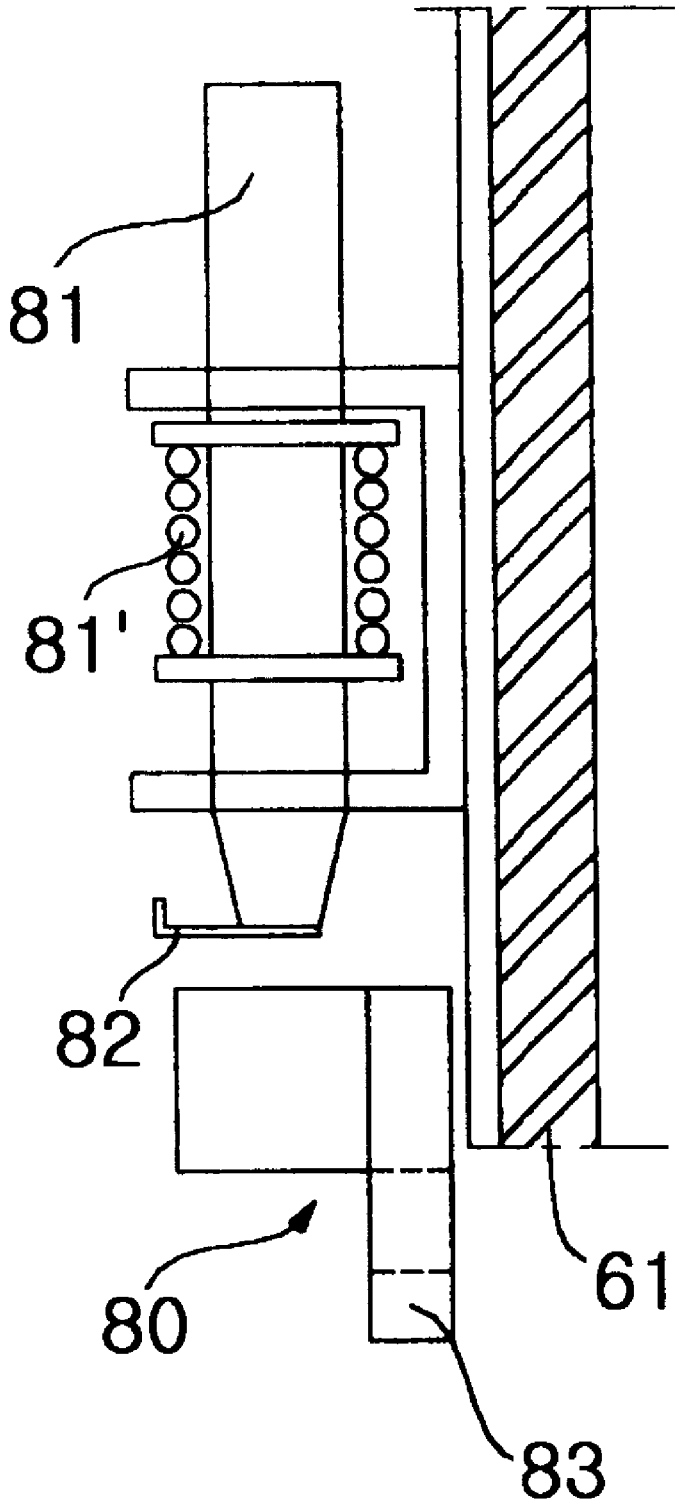
FIG. 6 is a sectional view showing the relocker cam bolt system of the present invention.

As shown in FIG. 6, the relocker cam bolt system 80 comprises a relocker cam bolt 81 which is inserted into a second spring 81' fixed to a bracket of the door and which is moved down by the second spring 81', a lock bolt holding bracket 82 formed to block the movement of the relocker cam bolt 81 until the lock bolt holding bracket 82 is damaged or deformed, and a second stop block 83 which is formed on the locker plate 61 and prevents the movement of the locker plate 61 when the relocker cam bolt 81 is moved down to be in contact with the second stop block 83.

Figure 11:
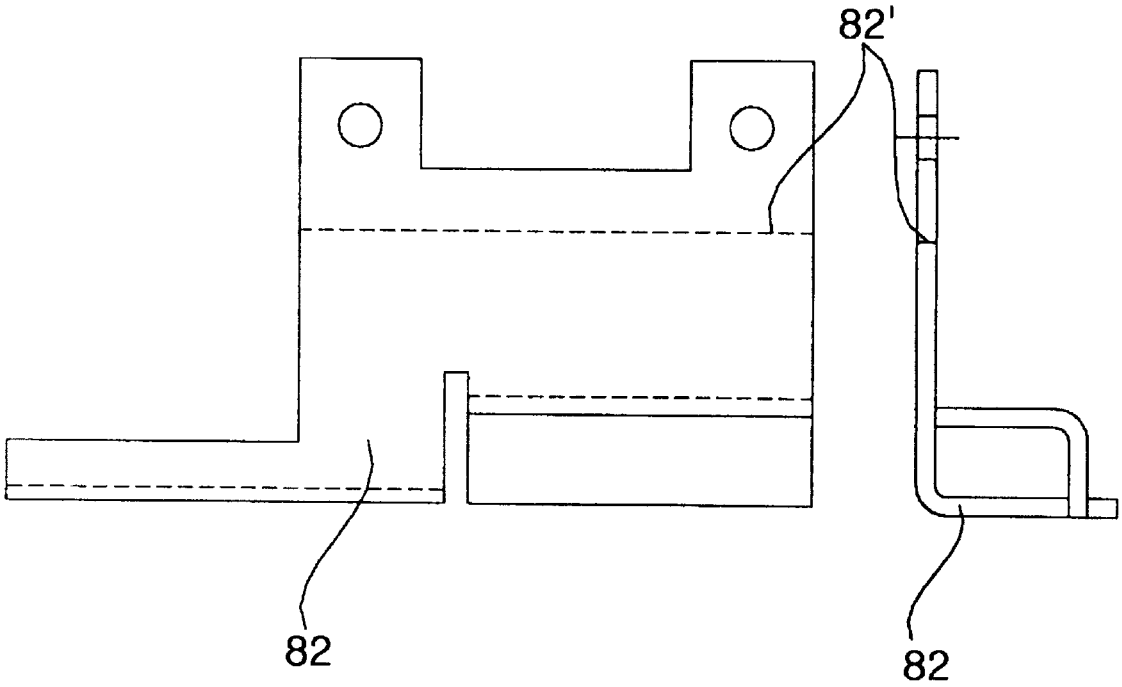
FIG. 11 is a view showing the cam bolt holding bracket of the present invention.

As shown in FIG. 11, in order that a lower part of the lock bolt holding bracket 82 can be immediately bent when the cam bolt portion of the combination lock 62 is attacked, a push groove line 82' is formed between the portion combined with the combination lock 62 and the cam bolt portion of the lock bolt holding bracket 82, and the cam bolt portion thereof is formed to be jutted toward the cam bolt 81 at a right angle so as to keep so small an interval between the bracket 82 and the cam bolt that the bracket 82 can be deformed immediately when the cam bolt is attacked.

Figure 10:
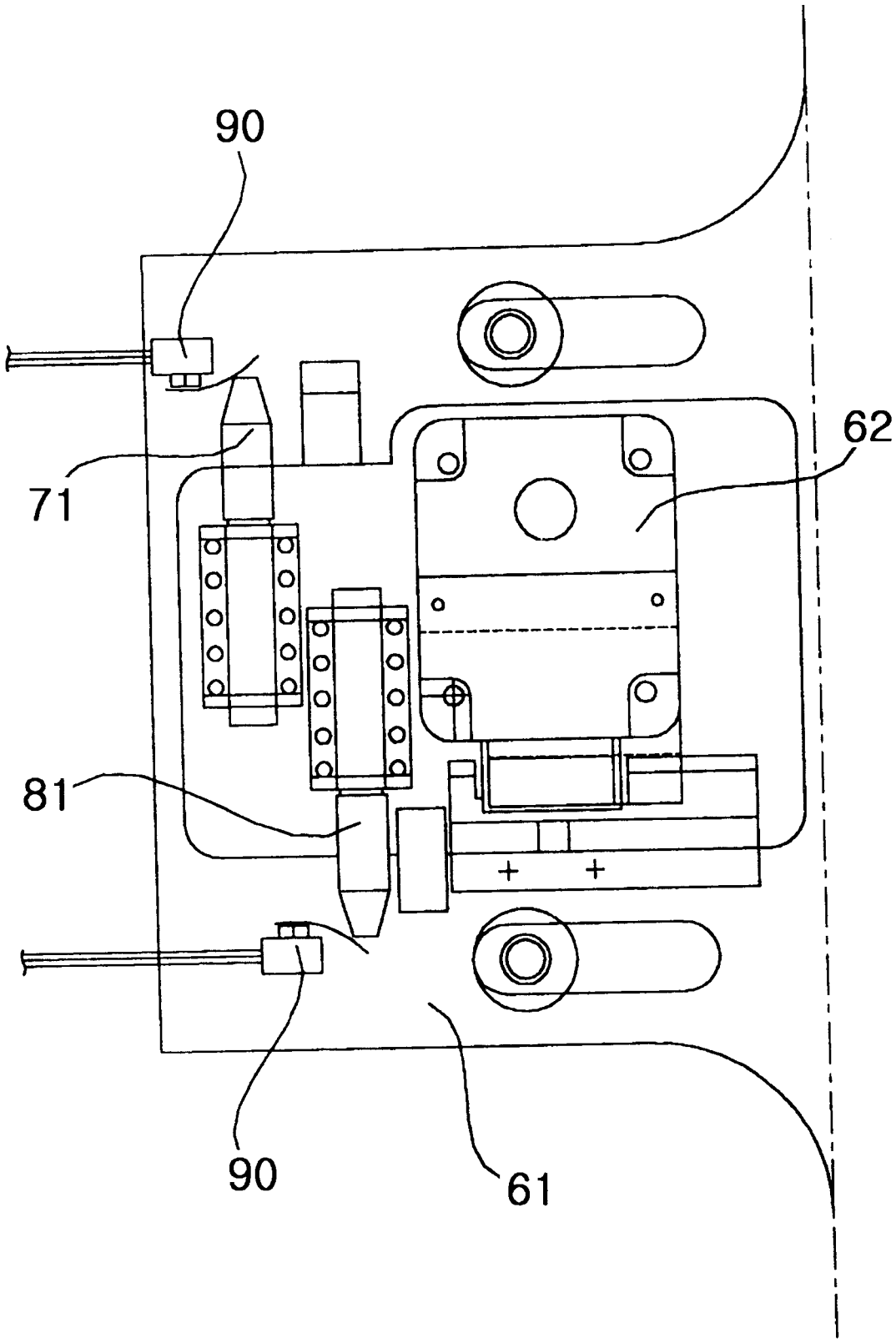

As shown in FIG. 10, two silent alarm micro switches 90 are disposed respectively above the relocker top 71 and below the relocker cam bolt 81. When the relocker top 71 or the relocker cam bolt 81 is forced up or down by a spring, the silent alarm micro switch 90 is turned on to transmit an alarm signal to a security center so that an invader cannot notice the alarm signal.

Figure 7:
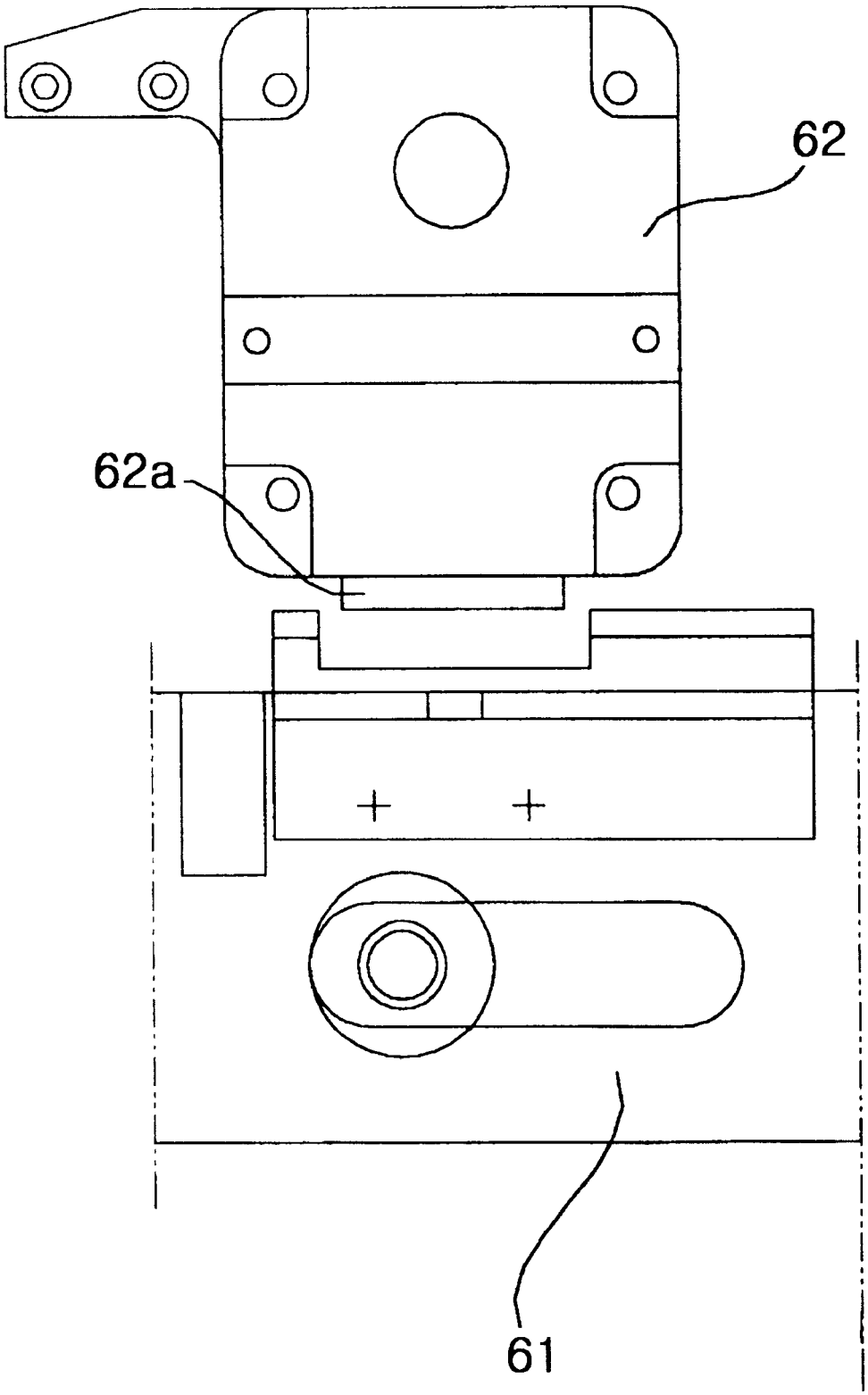
FIG. 7 is a view showing the combination lock when the door is normally opened in the locking system of the present invention.

FIG. 7 shows the locking system of the present invention when the door is normally opened. As in the conventional locking system, after the cam bolt retracts into the combination lock 62 by turning the dial, the locker plate 61 is moved to be free from the jamb by rotating the handle, and thereby the door is opened.

When an invader attacks the combination lock 62, the two relocking systems 70 and 80 independently operate according to the portion attacked by the invader.

Figure 8A:
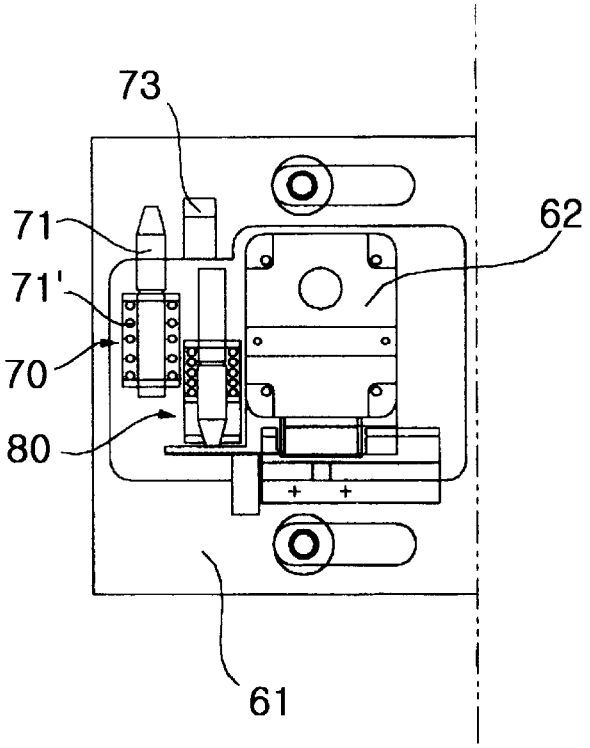
FIG. 8*a* and FIG. 8*b* are views showing the locking system of the present invention when the relocker top system is operated.
Figure 8B:
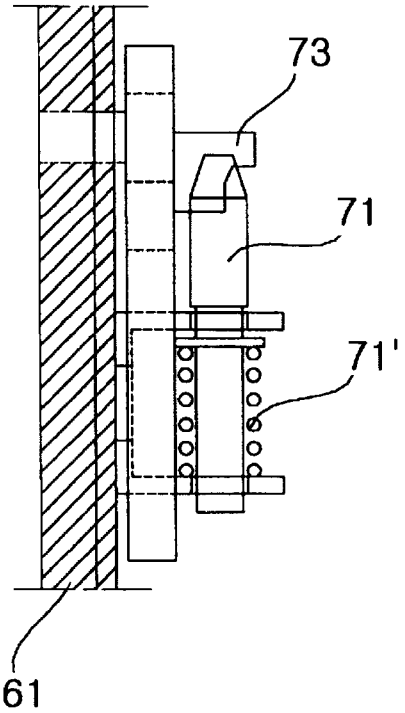

As shown in FIG. 8*a* and FIG. 8*b,* when the invader attacks or penetrates a dial portion of the combination lock 62, the lock cover 72 is deformed to release the relocker top 71. Consequently, the relocker top 71 is moved up by the first spring 71' to be in contact with the first stop block 73, thereby preventing movement of the locker plate 61. Therefore, although the invader manually unlocks the cam bolt of the combination lock 62, the door cannot be opened.

Figure 9A:
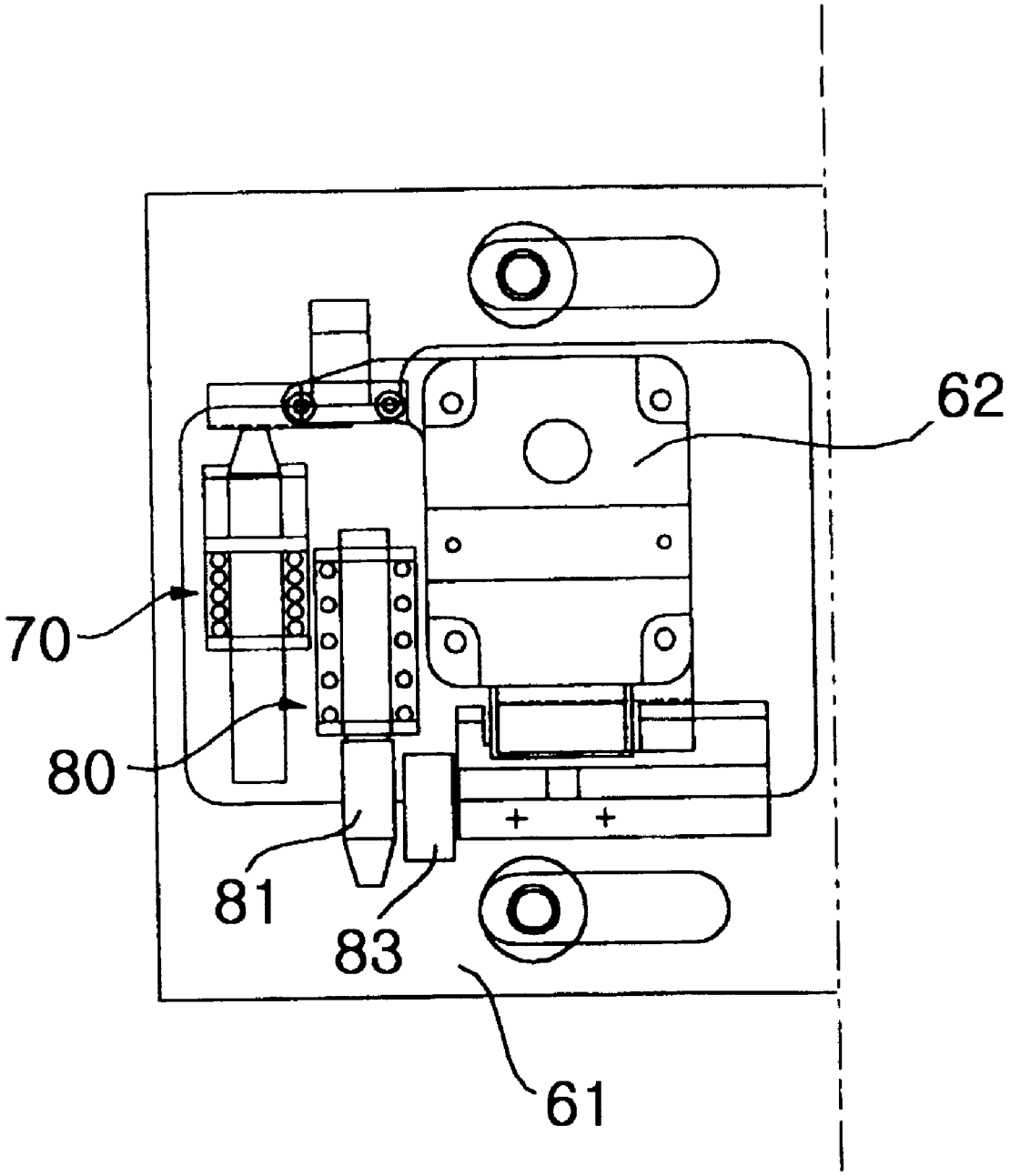
FIG. 9*a* and FIG. 9*b* are views showing the locking system of the present invention when the relocker cam bolt system is operated.
Figure 9B:
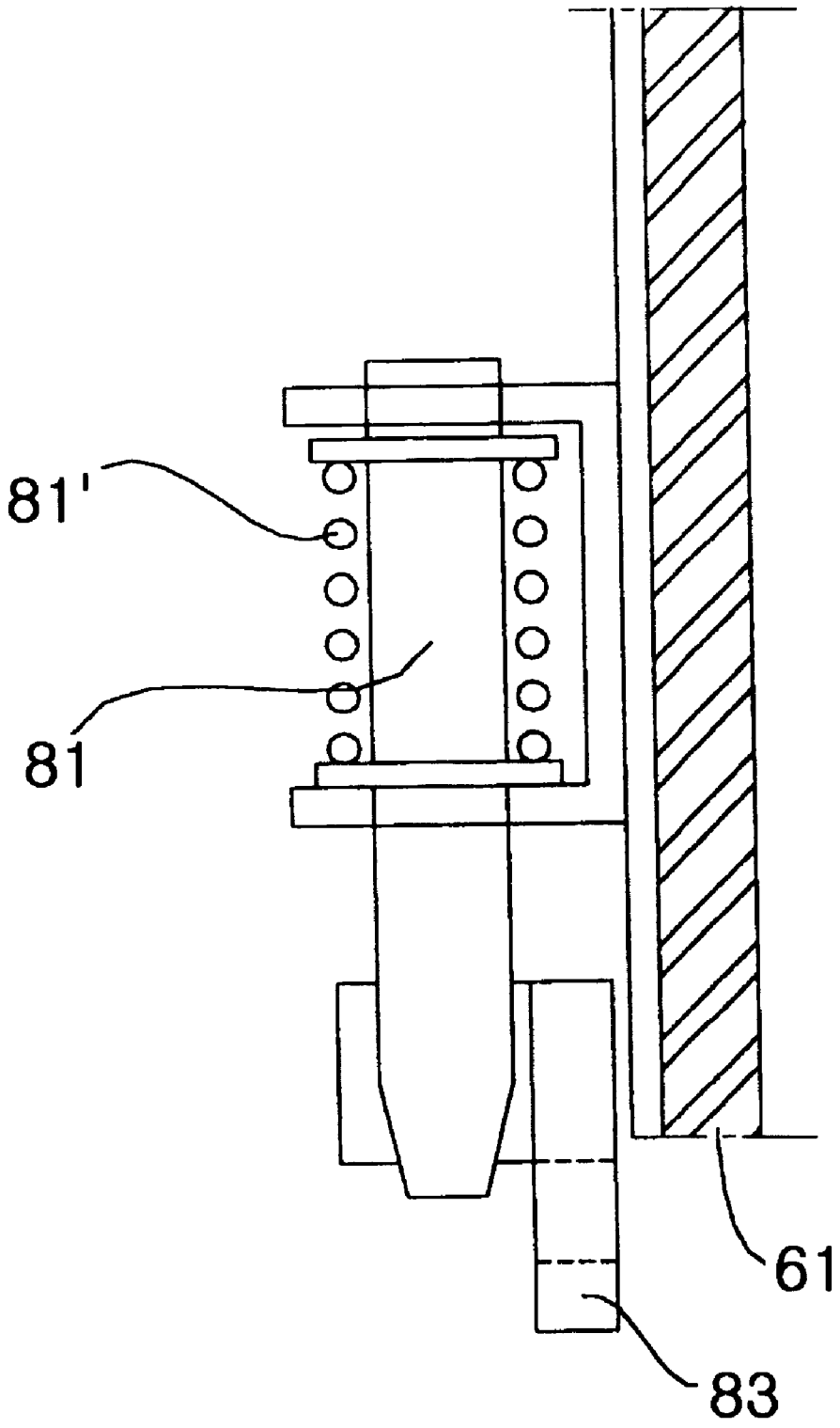

As shown in FIG. 9*a* and FIG. 9*b,* when the invader attacks or penetrates a cam bolt portion of the combination lock 62, the lock bolt holding bracket 82 is deformed, releasing the relocker cam bolt 1. Consequently, the relocker cam bolt 81 is moved down by the second spring 81' to be in contact with the second stop block 83, thereby preventing movement of the locker plate 61. Therefore, as in the relocker top system 71, the door cannot be opened.

At this time, as mentioned above, because the cam bolt portion of the lock bolt holding bracket 82 is bent toward the cam bolt so as to react sensitively to a drill attack, if being attacked, the lock bolt holding bracket 82 is deformed at once by the push groove line 82' so that the relocker cam bolt 81 can be immediately moved.

Further, when the relocker top system 70 or the relocker cam bolt system 81 is operated, the relocker top 71 or the relocker cam bolt 81 touches on the micro switch 90 so that the micro switch 90 transmits an alarm signal to the security center. In some cases, because the alarm signal does not sound around the security container so that the invader cannot notice the alarm signal, police or security men can secure a sufficient time to arrest the invader.

In the locking system for a security container according to the present invention, no matter what portion of the combination lock 62 is attacked, the double relocking system operates to fix the locker plate 61. Accordingly, the invader cannot open the door or requires too long time to forcefully open the door.

Further, when the double relocking system is operated, the micro switch 90 transmits a silent alarm signal to a security center so that an invader cannot notice the alarm signal. Accordingly, police or security men have sufficient time to arrest the invader.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A locking system for a security container, comprising:

a container;

a door hinged to said container;

a movable locker plate on said door controlling opening of said door;

a combination lock controlling movement of said locker plate;

a first relocking system preventing movement of said locker plate whenever a first portion of said combination lock is deformed; and a second relocking system preventing movement of said locker plate whenever a second portion of said combination lock is deformed.

2. The locking system according to claim 1, wherein said first portion of said combination lock includes a dial, and said second portion of said combination lock includes a cam bolt.

3. The locking system according to claim 2, wherein said first relocking system comprises:

a relocker top movably coupled to said door;

a cover blocking movement of said relocker top until said cover is deformed; and a first stop block on said locker plate preventing movement of said locker plate whenever said relocker top is contacting said first stop block.

4. The locking system according to claim 2, wherein said second relocking system comprises:

a relocker cam bolt movably coupled to said door;

a bracket blocking movement of said relocker cam bolt until said bracket is deformed; and a second stop block on said locker plate preventing movement of said locker plate when said relocker cam bolt is contacting said second stop block.

5. The locking system according to claim 3, further comprising a micro switch over said relocker top and transmitting an alarm signal whenever said relocker top contacts said switch.

6. The locking system according to claim 4, further comprising a micro switch under said relocker cam bolt and transmitting an alarm signal whenever said relocker cam bolt contacts said switch.

7. The locking system according to claim 4, wherein said bracket includes a groove facilitating bending of the bracket whenever said cam bolt is deformed.

8. The locking system according to claim 5, wherein said alarm signal includes a silent alarm signal.

9. The locking system according to claim 6, wherein said alarm signal includes a silent alarm signal.

10. The locking system according to claim 7, wherein said bracket is spaced a small interval from said cam bolt portion of said combination lock so that said bracket is immediately deformed when said cam bolt portion is attacked.

* * * * *